US010133226B2

(12) United States Patent
Kurotsu

(10) Patent No.: US 10,133,226 B2
(45) Date of Patent: Nov. 20, 2018

(54) IMAGE FORMING APPARATUS

(71) Applicant: KYOCERA Document Solutions Inc., Osaka (JP)

(72) Inventor: Yoshihiko Kurotsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/906,319

(22) Filed: Feb. 27, 2018

(65) Prior Publication Data

US 2018/0259892 A1 Sep. 13, 2018

(30) Foreign Application Priority Data

Mar. 8, 2017 (JP) ..... 2017-044241

(51) Int. Cl.
*G03G 15/00* (2006.01)
*G03G 21/16* (2006.01)
*G03G 15/20* (2006.01)

(52) U.S. Cl.
CPC ..... *G03G 15/55* (2013.01); *G03G 15/2064* (2013.01); *G03G 21/1633* (2013.01); *G03G 2221/1639* (2013.01)

(58) Field of Classification Search
CPC ..... G03G 2221/1639
See application file for complete search history.

(56) References Cited

U.S. PATENT DOCUMENTS

2007/0223977 A1* 9/2007 Matsubara ..... G03G 15/206 399/329
2011/0170891 A1* 7/2011 Inoue ..... G03G 15/206 399/67
2017/0068212 A1* 3/2017 Nanai ..... G03G 21/1889

FOREIGN PATENT DOCUMENTS

JP 2003-50522 A 2/2003

* cited by examiner

*Primary Examiner* — Clayton E Laballe
*Assistant Examiner* — Jas Sanghera
(74) *Attorney, Agent, or Firm* — Studebaker & Brackett PC

(57) ABSTRACT

An image forming apparatus includes a fixing unit and an apparatus main body. The fixing unit includes a first rotator, a second rotator, a temperature sensor, a switching mechanism, a switching sensor, and a unit side connector. The temperature sensor outputs a temperature signal corresponding to a temperature of the first rotator. The switching mechanism switches pressure of a fixing nip. The switching sensor outputs a switching signal corresponding to a position of the switching mechanism. The unit side connector is connected to the temperature sensor and the switching sensor. The apparatus main body includes a main body side connector and a controller. The main body side connector is connected to the unit side connector. The controller determines a state of attachment of the fixing unit to the apparatus main body on a basis of the temperature signal and the switching signal.

10 Claims, 9 Drawing Sheets

| TEMPERATURE SIGNAL | SWITCHING SIGNAL | DETERMINATION | DETECTION TIME |
|---|---|---|---|
| EQUAL TO OR HIGHER THAN ABNORMAL TEMPERATURE Ta | CONSTANT AS HIGH | FIXING UNIT IS NOT ATTACHED | 5 SECONDS |
| EQUAL TO OR HIGHER THAN ABNORMAL TEMPERATURE Ta | SWITCHED BETWEEN HIGH AND LOW | FIRST WIRE IS BROKEN | 5 SECONDS |
| LESS THAN ABNORMAL TEMPERATURE Ta | CONSTANT AS HIGH OR LOW | SWITCHING MECHANISM HAS MALFUNCTION | 8 SECONDS |
| LESS THAN ABNORMAL TEMPERATURE Ta | SWITCHED BETWEEN HIGH AND LOW | NORMAL | — |

FIG. 9

| TEMPERATURE SIGNAL | SWITCHING SIGNAL | DETERMINATION | DETECTION TIME |
|---|---|---|---|
| EQUAL TO OR HIGHER THAN ABNORMAL TEMPERATURE Ta | CONSTANT AS HIGH | FIXING UNIT IS NOT ATTACHED | 5 SECONDS |
| EQUAL TO OR HIGHER THAN ABNORMAL TEMPERATURE Ta | SWITCHED BETWEEN HIGH AND LOW | FIRST WIRE IS BROKEN | 5 SECONDS |
| LESS THAN ABNORMAL TEMPERATURE Ta | CONSTANT AS HIGH OR LOW | SWITCHING MECHANISM HAS MALFUNCTION | 8 SECONDS |
| LESS THAN ABNORMAL TEMPERATURE Ta | SWITCHED BETWEEN HIGH AND LOW | NORMAL | — |

IMAGE FORMING APPARATUS

INCORPORATION BY REFERENCE

This application is based on and claims the benefit of priority from Japanese patent application No. 2017-044241 filed on Mar. 8, 2017, which is incorporated by reference in its entirety.

BACKGROUND

The present disclosure relates to an image forming apparatus and more particularly relates to an image forming apparatus including a fixing unit that fixes a toner image on a recording medium.

An image forming apparatus, such as a printer, a copying machine, a facsimile, or a multifunctional peripheral, conventionally includes a fixing unit that fixes a toner image on a recording medium. The fixing unit is detachably attached to an apparatus main body of the image forming apparatus in consideration of convenience of maintenance.

An exclusive switch to verify that the fixing unit is attached to the apparatus main body is conventionally used. For example, as the fixing unit is attached to the apparatus main body, the fixing unit presses a push switch, and the switch outputs a detection signal, which enables the verification of the attachment of the fixing unit to the apparatus main body.

SUMMARY

In accordance with an aspect of the present disclosure, an image forming apparatus includes a fixing unit and an apparatus main body. The fixing unit fixes a toner image on a recording medium. To the apparatus main body, the fixing unit is detachably attached. The fixing unit includes a first rotator, a second rotator, a temperature sensor, a switching mechanism, a switching sensor, and a unit side connector. The first rotator is provided rotatably. The second rotator is provided rotatably and forms a fixing nip in cooperation with the first rotator. The temperature sensor outputs a temperature signal corresponding to a temperature of the first rotator. The switching mechanism switches pressure of the fixing nip. The switching sensor outputs a switching signal corresponding to a position of the switching mechanism. The unit side connector is connected to the temperature sensor and the switching sensor. The apparatus main body includes a main body side connector and a controller. The main body side connector is connected to the unit side connector as the fixing unit is attached to the apparatus main body. The controller is connected to the main body side connector and determines a state of attachment of the fixing unit to the apparatus main body on a basis of the temperature signal and the switching signal.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 9 is a table illustrating control on the basis of a switching signal and a temperature signal, in the image forming apparatus according to the one embodiment of the present disclosure.

DETAILED DESCRIPTION

Hereinafter, with reference to the drawings, an image forming apparatus 1 according to one embodiment of the present disclosure will be described. Arrows Fr, Rr, L, R, U and Lo shown in each figure respectively indicate a front side, a rear side, a left side, a right side, an upper side and a lower side of the image forming apparatus 1.

Firstly, an entire structure of the image forming apparatus 1 will be described. For example, the image forming apparatus 1 is a multifunctional peripheral which has multiple functions like a print function, a copy function, and a facsimile function.

Figure 1:
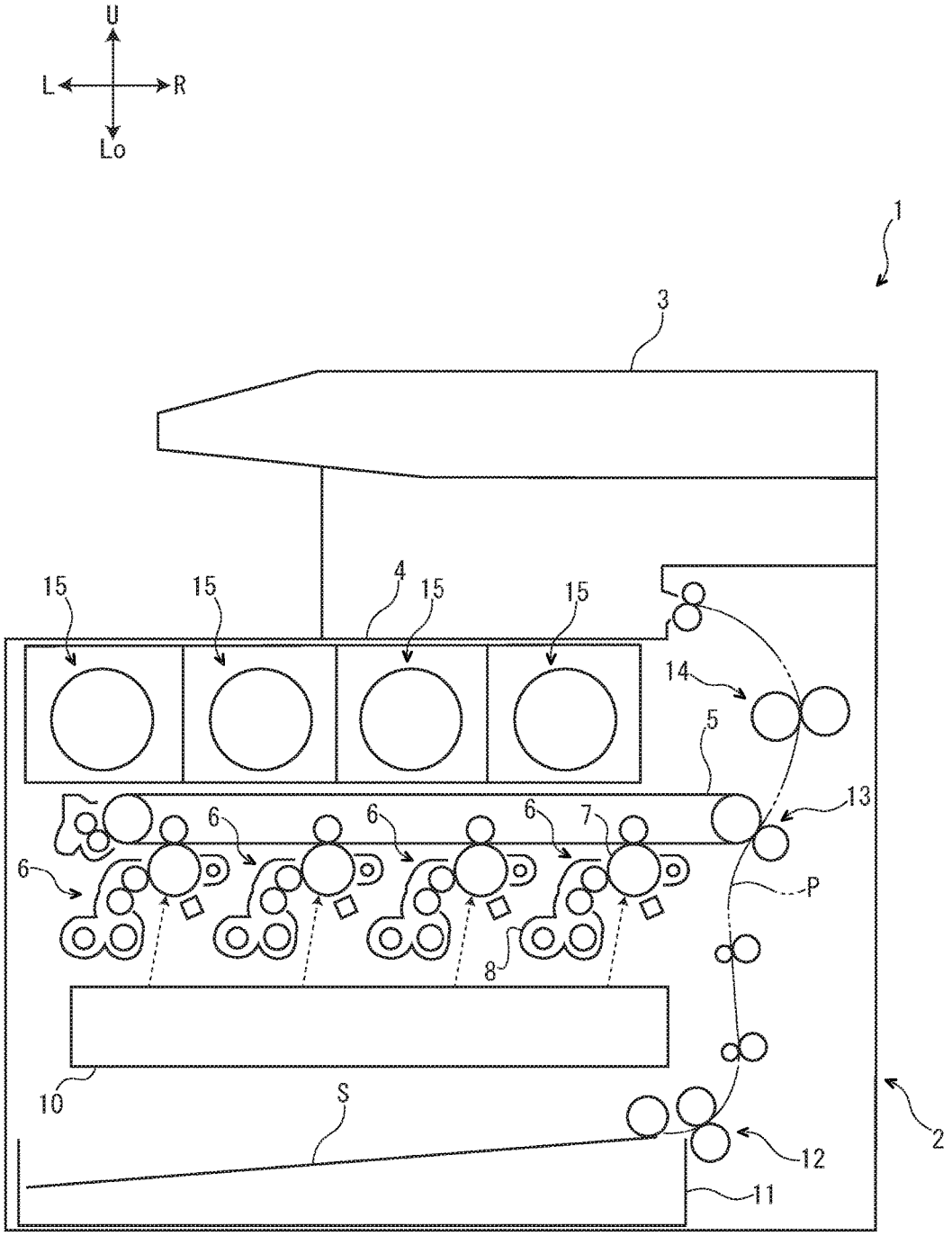
FIG. 1 is a schematic view illustrating an image forming apparatus according to one embodiment of the present disclosure.

With reference to FIG. 1, the image forming apparatus 1 includes a box-shaped apparatus main body 2. In an upper end portion of the apparatus main body 2, an image reading device 3 to read an original image is provided.

In an upper portion of the apparatus main body 2, an ejected sheet tray 4 is provided. In an approximate center portion of the apparatus main body 2, an intermediate transferring belt 5 and four image forming parts 6 are provided. Each image forming part 6 corresponds to, for example, each toner of black, cyan, magenta and yellow. Each image forming part 6 includes a photosensitive drum 7 (an example of an image carrier) and a developing device 8. In a lower portion of the apparatus main body 2, an exposing device 10 is provided. In a lower end port on of the apparatus main body 2, a sheet feeding cassette 11 storing a sheet S (an example of a recording medium) is provided.

In a right side portion of the apparatus main body 2, a conveying path P for the sheet S is provided. At an upstream end portion of the conveying path P, a sheet feeding part 12 is provided. At a middle portion of the conveying path P, a secondary transferring part 13 is provided. At a downstream portion of the conveying path P, a fixing unit 14 is provided.

In the upper portion of the apparatus main body 2, four toner containers 15 (an example of a toner case) are stored below the ejected sheet tray 4. Each toner container 15 corresponds to, for example, each toner of black, cyan, magenta and yellow, of the toner.

Next, an operation of the image forming apparatus 1 will be described.

Firstly, light (refer to a dot line arrow in FIG. 1) emitted from the exposing device 10 forms an electrostatic latent image on the photosensitive drum 7 of each image forming part 6. The electrostatic latent image is developed by the developing device 8 of each image forming part 6. Thereby, a toner image is carried on the photosensitive drum 7. The toner image is primarily transferred from the photosensitive drum 7 of each image forming part 6 to the intermediate transferring belt 5. Thereby, a full color toner image is formed on the intermediate transferring belt 5.

On the other hand, the sheet S fed from the sheet feeding cassette 11 by the sheet feeding part 12 is conveyed to a downstream side along the conveying path P and enters the secondary transferring part 13. At the secondary transferring part 13, the full color toner image formed on the intermediate transferring belt 5 is secondarily transferred to the sheet S. The sheet S on which the toner image is secondarily transferred is further conveyed to the downstream side along the conveying path P and enters the fixing unit 14. The fixing unit 14 fixes the toner image on the sheet S. The sheet S on which the toner image is fixed is ejected on the ejected sheet tray 4.

Next, the apparatus main body 2 will be further described.

Figure 2:
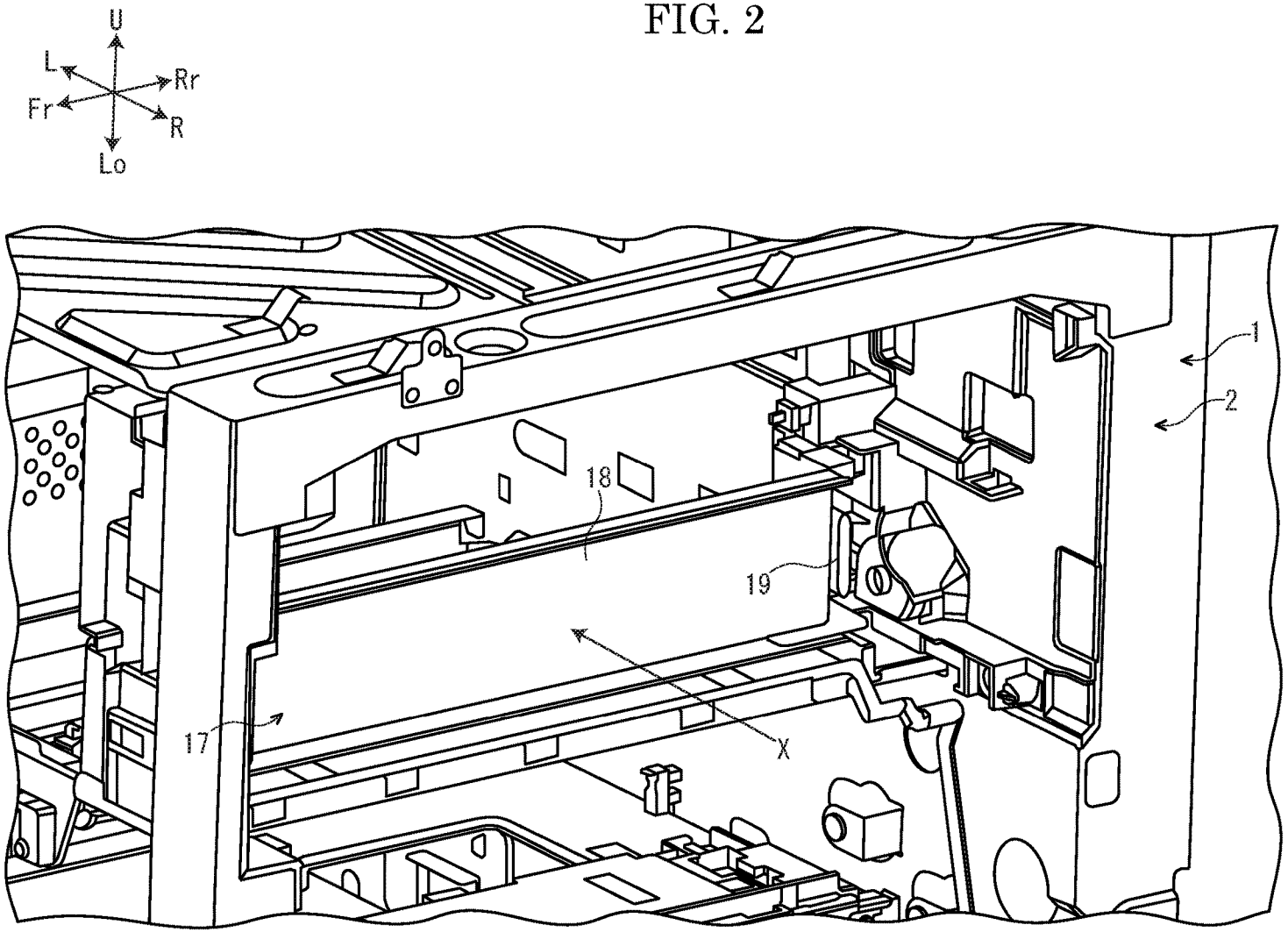
FIG. 2 is a perspective view illustrating an apparatus main body according to the one embodiment of the present disclosure.
Figure 3:
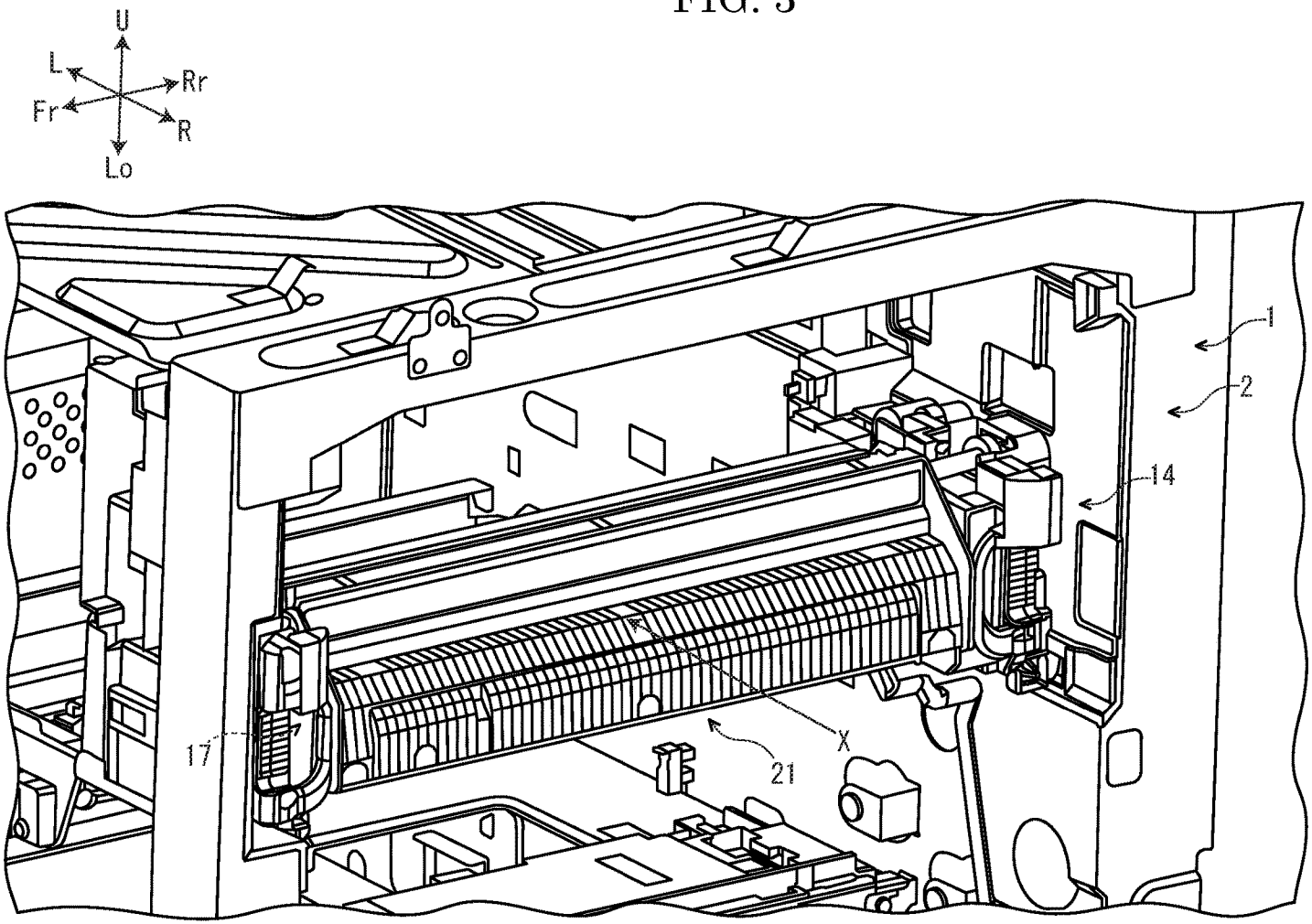
FIG. 3 is a perspective view illustrating the apparatus main body and a fixing unit according to the one embodiment of the present disclosure.

With reference to FIGS. 2 and 3, a unit attachment part 17 is provided in the right side part of the apparatus main body 2. The right face of the unit attachment part 17 is covered with an openable and closable exterior cover (not illustrated). To the unit attachment part 17, the fixing unit 14 is detachably attached along an attachment direction X from the right side to the left side. A side plate 18 is provided in an approximately vertical posture on the left end side of the unit attachment part 17. A main body side connector 19 is provided on the rear side of the side plate 18. A connection terminal (not illustrated) or the like is mounted on the main body side connector 19.

Next, the fixing unit 14 will be further described.

Figure 4:
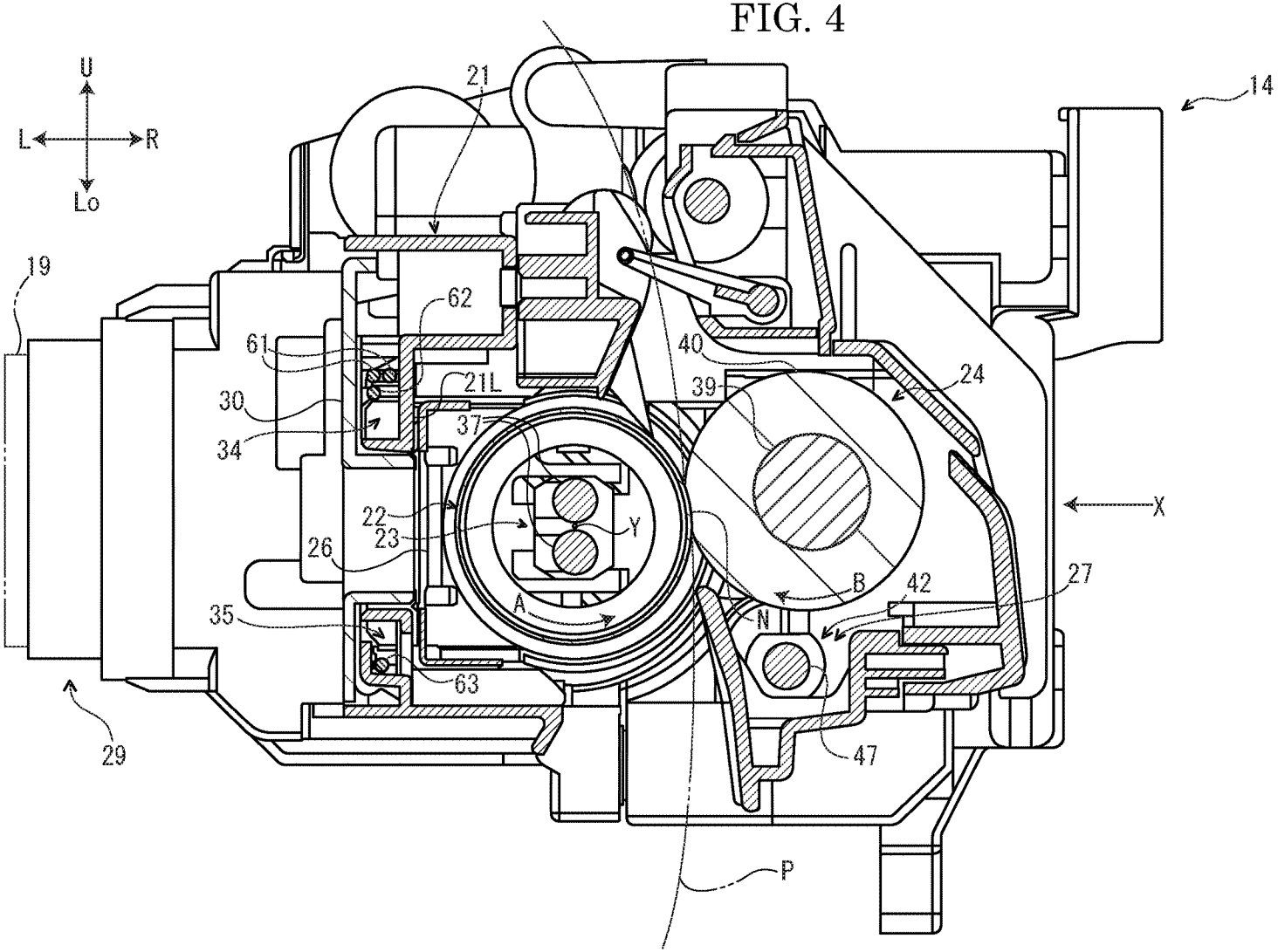
FIG. 4 is a sectional view illustrating the fixing unit according to the one embodiment of the present disclosure.
Figure 5:
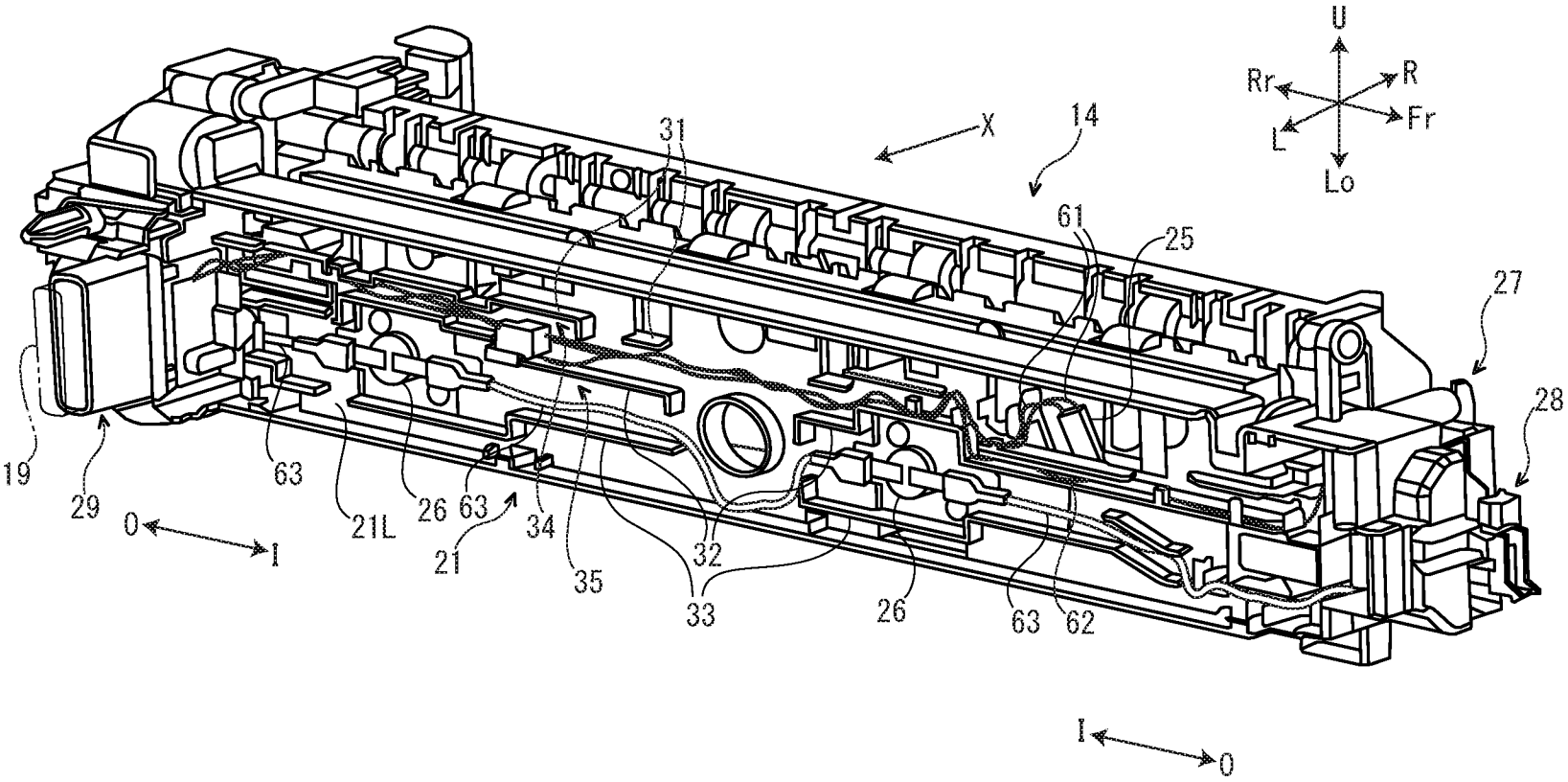
FIG. 5 is a perspective view illustrating the fixing unit according to the one embodiment of the present disclosure.

With reference to FIGS. 4 and 5, the fixing unit 14 includes a unit main body 21, a heating roller 22 (one example of a first rotator) stored in the left side part of the unit main body 21, a heat source 23 stored in the heating roller 22, a pressing roller 24 (one example of a second rotator) stored in the right side part of the unit main body 21, a temperature sensor 25 arranged in the front part of the unit main body 21, a pair of heating stoppers 26 arranged in the front and rear parts of the unit main body 21, a switching mechanism 27 arranged from the front end side to the rear end side of the unit main body 21, a switching sensor 28 arranged on the front side of the switching mechanism 27, and a unit side connector 29 arranged on the rear end side of the unit main body 21.

The unit main body 21 of the fixing unit 14 has a shape elongated in the front-and-rear direction. The left face (outer face) of the left side wall 21L of the unit main body 21 is covered with a cover 30. In FIG. 5, the cover 30 is omitted.

Plural first protrusions 31, plural second protrusions 32 arranged on the lower side with respect to the plural first protrusions 31, and plural third protrusions 33 arranged on the lower side with respect to the plural second protrusions 32 are provided on the left face (outer face) of the left side wall 21L of the unit main body 21. An upper side guiding part 34 (one example of a first guiding part) along the front-and-rear direction is provided between the plural first protrusions 31 and the plural second protrusions 32. A lower side guiding part 35 (one example of a second guiding part) along the front-and-rear direction is provided between the plural second protrusions 32 and the plural third protrusions 33.

The heating roller 22 of the fixing unit 14 has a cylindrical shape elongated in the front-and-rear direction. The heating roller 22 is rotatably provided around a rotation axis Y extended along the front-and-rear direction. That is, in the present embodiment, the front-and-rear direction corresponds to a rotation axis direction of the heating roller 22. The heating roller 22 has no flexibility.

The heat source 23 of the fixing unit 14 has a shape elongated in the front-and-rear direction. For example, a pair of upper and lower halogen heaters 37 constitutes the heat source 23. The heat source 23 is configured to heat the heating roller 22 from the inner side in the radial direction.

The pressing roller 24 of the fixing unit 14 has a columnar shape elongated in the front-and-rear direction. The pressing roller 24 is rotatably provided. The pressing roller 24 comes in contact with the heating roller 22 under predetermined pressure, thereby forming a fixing nip N in cooperation with the heating roller 22. Hereinafter, the pressure (pressure applied to a sheet S at the fixing nip N) of the fixing nip N is referred to as "nip pressure". The pressing roller 24 includes a roller shaft 39 extended along the front-and-rear direction and an elastic body 40 to cover the outer circumference of the roller shaft 39.

For example, a thermistor constitutes the temperature sensor 25 of the fixing unit 14. The temperature sensor 25 comes in contact with the surface of the heating roller 22 or faces the surface of the heating roller 22 with a gap left. The temperature sensor 25 is configured to detect a surface temperature of the heating roller 22 and output a temperature signal corresponding to the surface temperature of the heating roller 22.

For example, a bimetal thermostat constitutes each heating stopper 26 of the fixing unit 14. Each heating stopper 26 faces the surface of the heating roller 22 with a gap left. Each heating stopper 26 is configured to operate at a temperature higher than a temperature at which the fixing unit 14 normally operates, and cause the heat source 23 to stop heating the heating roller 22.

Figure 6:
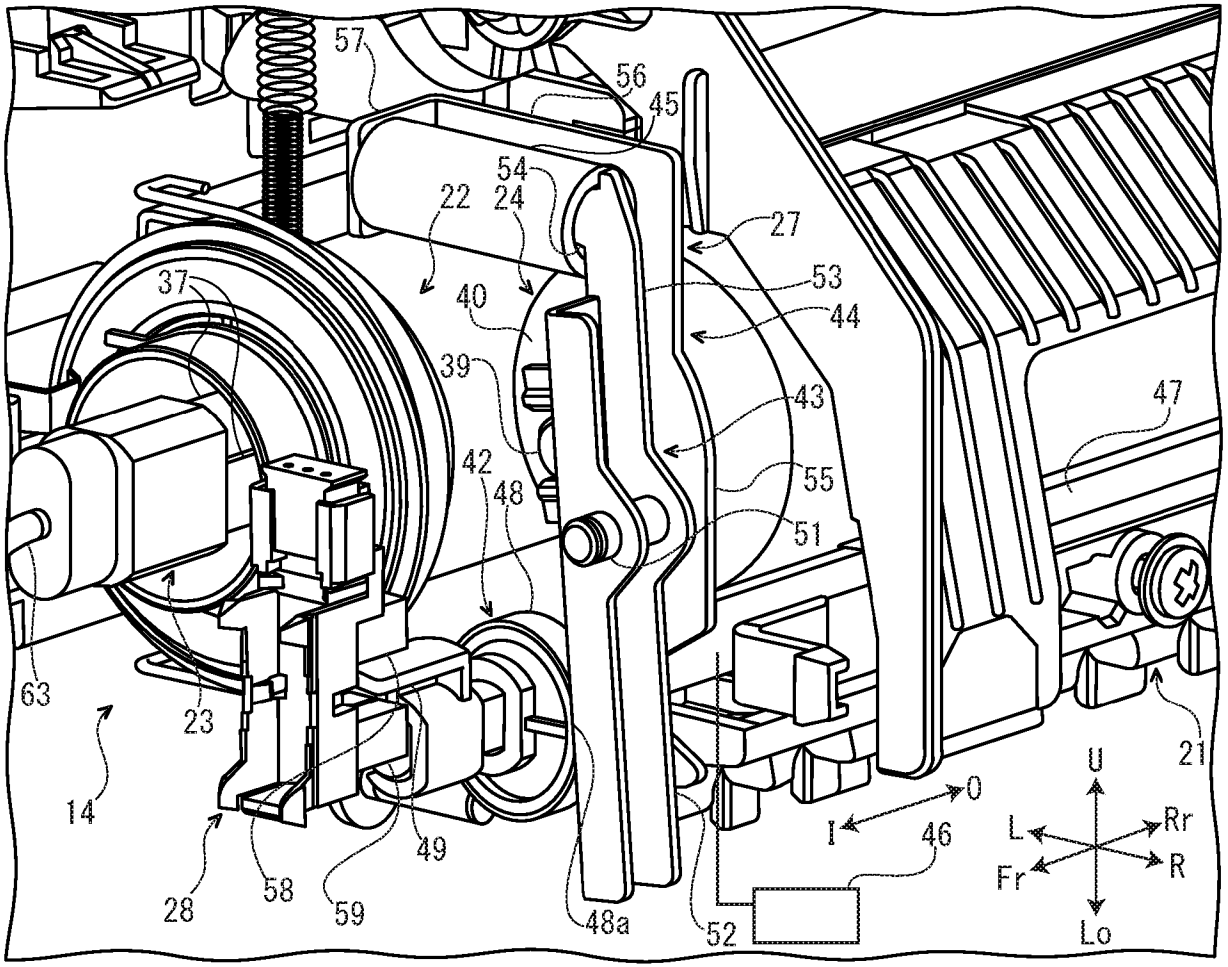
FIG. 6 is a perspective view illustrating a state where a switching mechanism is at a first position, in the fixing unit according to the one embodiment of the present disclosure.
Figure 7:
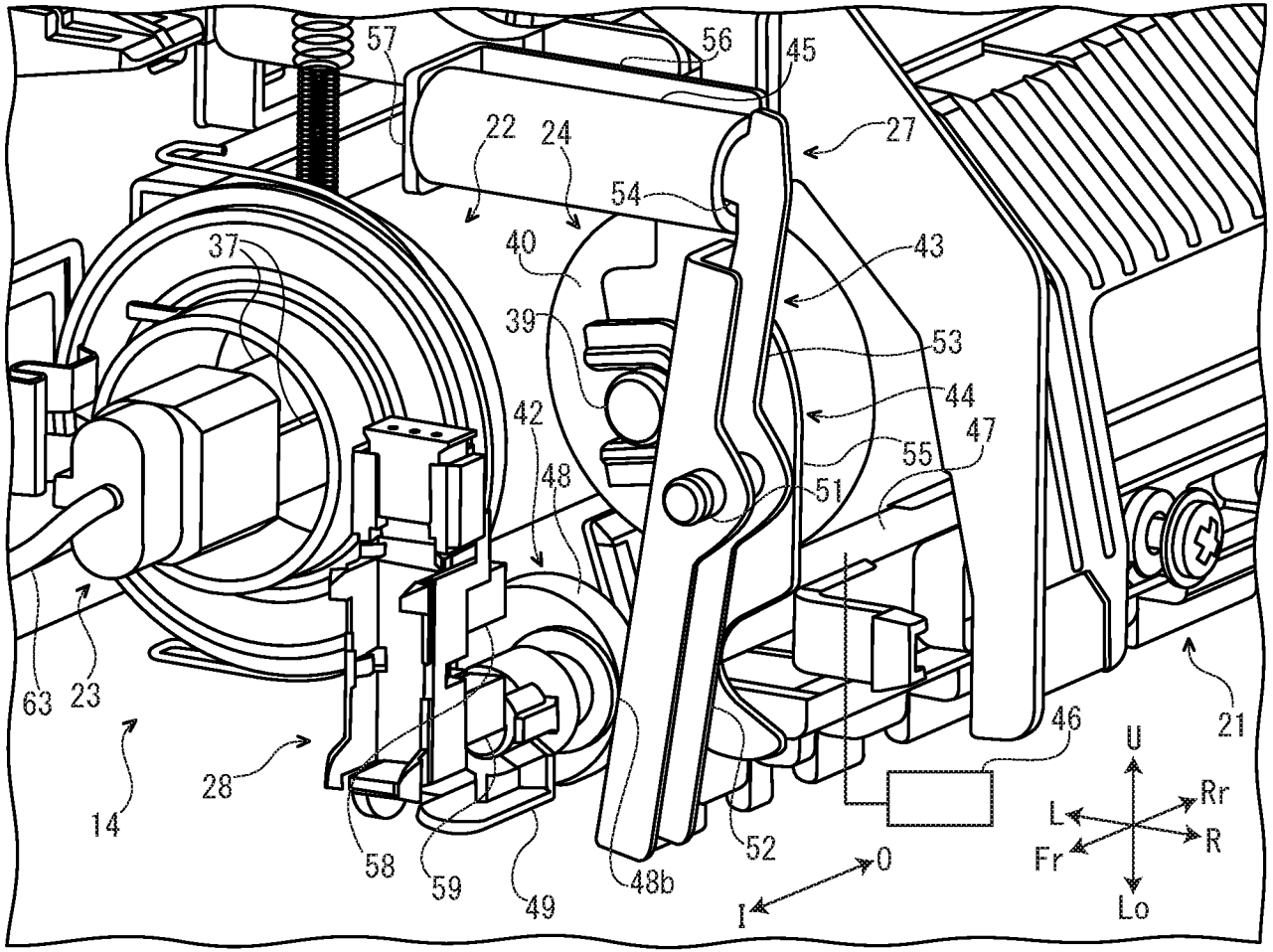
FIG. 7 is a perspective view illustrating a state where the switching mechanism is at a second position, in the fixing unit according to the one embodiment of the present disclosure.

With reference to FIGS. 6 and 7, the switching mechanism 27 of the fixing unit 14 includes a switching member 42, and swinging members 43, pressing plates 44, and pressing springs 45 each provided on the front end side and the rear end side of the switching member 42 (in FIGS. 6 and 7, only the swinging member 43, the pressing plate 44, and the pressing spring 45 provided on the front end side are illustrated).

The switching member 42 of the switching mechanism 27 is configured to be connected to a driving source 46 constituted by a motor and rotate by the driving force of the driving source 46. The switching member 42 includes a rotation axis 47 extended along the front-and-rear direction, cams 48 each fixed to the front part and the rear part of the rotation axis 47 (in FIGS. 6 and 7, only the cam 48 fixed to the front part of the rotation axis 47 is illustrated), an actuator 49 fixed to the front end part of the rotation axis 47. Each cam 48 includes a large diameter part 48*a* and a small diameter part 48*b*. A distance from the center of rotation of the switching member 42 to the large diameter part 48*a* is greater than a distance from the center of rotation of the switching member 42 to the small diameter part 48*b*.

Each swinging member 43 of the switching mechanism 27 has a shape elongated in an up-and-down direction. Each swinging member 43 is swingably provided, centering on a swinging axis 51. Each swinging member 43 includes a lower side arm part 52 extended from the swinging axis 51 to the lower side and an upper side arm part 53 extended from the swinging axis 51 to the upper side. The lower side arm part 52 comes in contact with each cam 48 of the switching member 42. An engaging part 54 is provided at the upper end part of the upper side arm part 53.

Each pressing plate 44 of the switching mechanism 27 includes a supporting plate 55, an extending plate 56 extended from the upper end part of the supporting plate 55 to the left side, and an engaging plate 57 bent from the left end part of the extending plate 56 to the front side. Both front and rear end parts of the roller shaft 39 of the pressing roller 24 (in FIGS. 6 and 7, only the front end part of the roller shaft 39 is illustrated) are rotatably supported by a center part in the up-and-down direction of the supporting plate 55.

The left-and-right direction corresponds to an axial direction of each pressing spring 45 of the switching mechanism 27. The right end part of each pressing spring 45 is engaged with the engaging part 54 of the upper side arm part 53 of each swinging member 43. The left end part of each pressing spring 45 is engaged with the engaging plate 57 of each pressing plate 44. That is, each pressing spring 45 is arranged between each swinging member 43 and each pressing plate 44.

A photo interrupter sensor (PI sensor) constitutes the switching sensor 28 of the fixing unit 14. The switching sensor 28 includes a light emitting part 58 to emit light and a light receiving part 59 to receive the light emitted by the light emitting part 58.

With reference to FIGS. 4 and 5, the unit side connector 29 of the fixing unit 14 protrudes from the rear end part of the unit main body 21 to the left side. A connection terminal (not illustrated) or the like is mounted on the unit side connector 29. As the fixing unit 14 is attached to the apparatus main body 2, the unit side connector 29 is connected to the main body side connector 19 of the apparatus main body 2.

The unit side connector 29 is connected to the temperature sensor 25 via a pair of first wires 61. The unit side connector 29 is connected to the switching sensor 28 via a second wire 62. The pair of first wires 61 and the second wire 62 are guided along the front-and-rear direction by the upper side guiding part 34 of the unit main body 21. The unit side connector 29 is connected to the heat source 23 and each heating stopper 26 via plural cables 63. Each cable 63 is guided along the front-and-rear direction by the lower side guiding part 35 of the unit main body 21.

Next, the control system of the image forming apparatus 1 will be described.

Figure 8:
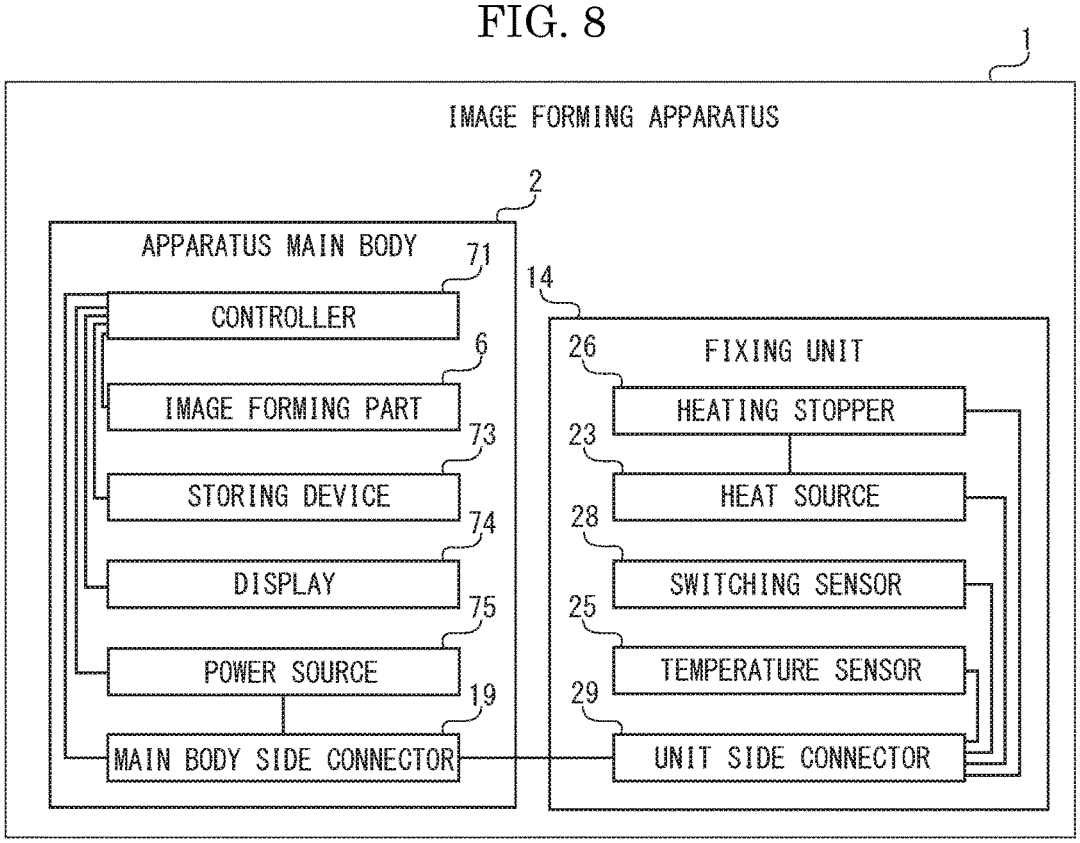
FIG. 8 is a schematic block diagram illustrating a control system of the image forming apparatus according to the one embodiment of the present disclosure.

With reference to FIG. 8, the apparatus main body 2 includes a controller 71. For example, a central processing unit (CPU) constitutes the controller 71. The controller 71 is connected to each part (e.g., the image forming part 6) of the apparatus main body 2 and controls each part of the apparatus main body 2. The controller 71 is connected to the main body side connector 19 with a signal line (not illustrated).

The apparatus main body 2 includes a storing device 73. For example, a read-only memory (ROM) or a random access memory (RAM) constitutes the storing device 73. The storing device 73 is connected to the controller 71. The storing device 73 stores programs and data for control. The storing device 73 stores an abnormal temperature Ta (e.g., 230 degrees C.) higher than a surface temperature Ts (e.g., 150 to 170 degrees C.) of the heating roller 22 at a time when the fixing unit 14 normally operates.

The apparatus main body 2 includes a display 74. For example, a liquid crystal display (LCD) constitutes the display 74. The display 74 is connected to the controller 71 and displays various screens (e.g., an operation screen or an error display screen) on the basis of a signal from the controller 71.

The apparatus main body 2 includes a power source 75. The power source 75 is connected to the controller 71 and supplies electric power to each part (e.g., the image forming part 6) of the apparatus main body 2 on the basis of a signal from the controller 71. The power source 75 is connected to the main body side connector 19 with an electric wire (not illustrated).

Next, the operation of fixing a toner image to a sheet in the image forming apparatus 1 with the aforementioned configuration will be described.

When the toner image is fixed to the sheet, electric power is supplied from the power source 75 to the heat source 23 via the main body side connector 19 and the unit side connector 29 on the basis of a signal from the controller 71. Following this, the heat source 23 operates and heats the heating roller 22. Further, when the toner image is fixed to the sheet, the heating roller 22 is rotated (see an arrow A in FIG. 4). Thus, when the heating roller 22 rotates, the pressing roller 24 in contact with the heating roller 22 is driven to rotate by the heating roller 22 (see an arrow B in FIG. 4). In this state, when the sheet conveyed along the conveying path P passes through the fixing nip N, the sheet is heated and pressed by the heating roller 22 and the pressing roller 24 at the fixing nip N, thereby fixing the toner image on the sheet.

Next, the operation of switching the nip pressure in the image forming apparatus 1 with the aforementioned configuration will be described.

With reference to FIG. 6, when the toner image is fixed to plain paper, the large diameter part 48*a* of each cam 48 of the switching member 42 comes in contact with the lower side arm part 52 of each swinging member 43. Following this, the upper side arm part 53 of each swinging member 43 presses the pressing roller 24 by first pressing force F1 to the side of the heating roller 22 via each pressing spring 45 and each pressing plate 44. Following this, the nip pressure reaches first pressure P1. A position of the switching mechanism 27 at this time is referred to as a first position.

Thus, in a state where the switching mechanism 27 is arranged at the first position, the actuator 49 of the switching member 42 is arranged between the light emitting part 58 and the light receiving part 59 of the switching sensor 28. Consequently, the light emitted by the light emitting part 58 is blocked by the actuator 49 and fails to reach the light receiving part 59. In this case, the switching sensor 28 outputs LOW (one example of a first signal) as a switching signal, and the LOW output is inputted to the controller 71.

In contrast, when the toner image is fixed on an envelope in a state where the nip pressure reaches the first pressure P1, excessively high nip pressure may cause wrinkles on the envelope. Further, when a sheet jammed at the fixing nip N is removed in the state where the nip pressure reaches the first pressure P1, the excessively high nip pressure may make it difficult to remove the sheet.

Thus, with reference to FIG. 7, when the toner image is fixed on the envelope, or when the sheet jammed at the fixing nip N is removed, the driving source 46 causes the switching member 42 to rotate for a predetermined time and brings the small diameter part 48*b* of each cam 48 of the switching member 42 into contact with the lower side arm part 52 of each swinging member 43. Following this, force by which the upper side arm part 53 of each swinging member 43 presses the pressing roller 24 to the side of the heating roller 22 via each pressing spring 45 and each pressing plate 44 is switched from the first pressing force F1 to second pressing force F2 (F2<F1). Following this, the nip pressure is switched from the first pressure P1 to second pressure P2 (P2<P1). A position of the switching mechanism 27 at this time is referred to as a second position. As described above, the nip pressure is switched from the first pressure P1 to the second pressure P2, thereby preventing the wrinkles from being formed on the envelope, and easily removing the sheet jammed at the fixing nip N.

Thus, when the switching mechanism 27 shifts from the first position to the second position, the actuator 49 of the switching member 42 is separated from a position interposed between the light emitting part 58 and the light receiving part 59 of the switching sensor 28. Consequently, the light emitted by the light emitting part 58 is not blocked by the actuator 49 and reaches the light receiving part 59. In this case, the switching sensor 28 outputs HIGH (one example of a second signal) as the switching signal, and the HIGH output is inputted to the controller 71.

In contrast, with reference to FIG. 6, when the toner image is fixed again on the plain paper after the completion of the operation of fixing the toner image on the envelope or the operation of removing the sheet jammed at the fixing nip N, the driving source 46 causes the switching member 42 to rotate for a predetermined time and brings the large diameter part 48*a* of each cam 48 of the switching member 42 into contact with the lower side arm part 52 of each swinging member 43. Following this, the force by which the upper side arm part 53 of each swinging member 43 presses the pressing roller 24 to the side of the heating roller 22 via each pressing spring 45 and each pressing plate 44 is switched from the second pressing force F2 to the first pressing force F1. Following this, the nip pressure is switched from the second pressure P2 to the first pressure P1. A position of the switching mechanism 27 at this time corresponds to the aforementioned first position.

Thus, when the switching mechanism 27 shifts from the second position to the first position, the actuator 49 of the switching member 42 is arranged between the light emitting part 58 and the light receiving part 59 of the switching sensor 28. Consequently, the light emitted by the light emitting part 58 is blocked by the actuator 49 and fails to reach the light receiving part 59. In this case, the switching sensor 28 outputs LOW as the switching signal, and the LOW output is inputted to the controller 71.

As described above, in the present embodiment, the nip pressure is switched by the switching mechanism 27. The switching sensor 28 is configured to detect the position (the first position or the second position) of the switching mechanism 27 and output the switching signal (LOW or HIGH) corresponding to the position of the switching mechanism 27.

Next, in the image forming apparatus 1 with the aforementioned configuration, control on the basis of the temperature signal and the switching signal will be described with reference to FIG. 9.

When the temperature signal is not inputted after a lapse of a predetermined detection time, the controller 71 is configured to determine that the temperature signal corresponding to a temperature equal to or higher than the abnormal temperature Ta is inputted, not to determine that the temperature signal is not inputted. Further, when the switching signal is not inputted after a lapse of a predetermined detection time, the controller 71 is configured to determine that the switching signal remains constant as HIGH, not to determine that the switching signal is not inputted.

When the temperature signal and the switching signal are not inputted in a predetermined detection time (e.g., five seconds), the controller 71 determines that the temperature signal corresponding to a temperature equal to or higher than the abnormal temperature Ta has been inputted and determines that the switching signal remains constant with HIGH. In this case, the controller 71 determines that the fixing unit 14 is not attached to the apparatus main body 2, causes the image forming part 6 to stop the image forming operation, and causes the display 74 to display a message that informs a user that the fixing unit 14 is not attached to the apparatus main body 2.

In contrast, when the temperature signal is not inputted, and the switching signal switched between HIGH and LOW is inputted in a predetermined detection time (e.g., five seconds), the controller 71 determines that the temperature signal corresponding to a temperature equal to or higher than the abnormal temperature Ta has been inputted and determines that the switching signal switched between HIGH and LOW has been inputted. In this case, the controller 71 determines that the fixing unit 14 is attached to the apparatus main body 2 and that the first wire 61 is broken, causes the image forming part 6 to stop the image forming operation, and causes the display 74 to display an error message that urges a user to call out a service engineer.

In contrast, when the temperature signal corresponding to a temperature less than the abnormal temperature Ta is inputted, and the switching signal that remains constant as HIGH or LOW is inputted in a predetermined detection time (e.g., eight seconds), the controller 71 determines that the temperature signal corresponding to a temperature less than the abnormal temperature Ta has been inputted and determines that the switching signal that remains constant as HIGH or LOW has been inputted. That is, the controller 71 acknowledges the input results of the temperature signal and the switching signal as they are. In this case, the controller 71 determines that the fixing unit 14 is attached to the apparatus main body 2 and that the switching mechanism 27 has a malfunction, causes the image forming part 6 to stop the image forming operation, and causes the display 74 to display an error message that urges a user to call out a service engineer.

In contrast, when a temperature signal corresponding to a temperature less than the abnormal temperature Ta is inputted, and a switching signal switched between HIGH and LOW is inputted, the controller 71 determines that the temperature signal corresponding to a temperature less than the abnormal temperature Ta has been inputted, and that the switching signal switched between HIGH and LOW has been inputted. That is, the controller 71 acknowledges the input results of the temperature signal and the switching signal as they are. In this case, the controller 71 determines that the fixing unit 14 is attached to the apparatus main body 2 and that the fixing unit 14 normally operates, and causes the image forming part 6 to carry out the image forming operation.

As described above, the controller 71 determines a state of attachment of the fixing unit 14 to the apparatus main body 2 on the basis of the temperature signal and the switching signal. The introduction of the aforementioned configuration enables the controller 71 to determine a state of attachment of the fixing unit 14 to the apparatus main body 2 without using an exclusive switch, thereby suppressing an increase in the number of components of the image forming apparatus 1 and suppressing the complication of the configuration of the image forming apparatus 1.

When the temperature signal and the switching signal are not inputted, the controller 71 determines that the fixing unit 14 is not attached to the apparatus main body 2 and, when at least one of the temperature signal and the switching signal is inputted, the controller 71 determines that the fixing unit 14 is attached to the apparatus main body 2. The introduction of the aforementioned configuration enables the controller 71 to accurately determine a state of attachment of the fixing unit 14 to the apparatus main body 2.

When the temperature signal is not inputted, and the switching signal switched between HIGH and LOW is inputted, the controller 71 determines that the first wire 61 is broken, and when the temperature signal is inputted, and the switching signal that remains constant as HIGH or LOW is inputted, the controller 71 determines that the switching mechanism 27 has a malfunction, and when the temperature signal is inputted, and the switching signal switched between HIGH and LOW is inputted, the controller 71 determines that the fixing unit 14 normally operates. The introduction of the aforementioned configuration enables the controller 71 to simultaneously make a determination on whether the first wire 61 is broken, a determination on whether the switching mechanism 27 has a malfunction, and a determination on whether the fixing unit 14 is attached to the apparatus main body 2, on the basis of the temperature signal and the switching signal.

When the controller 71 determines that the switching mechanism 27 has a malfunction, the controller 71 increases the detection time of the temperature signal and the switching signal, compared with the case where the controller 71 determines that the fixing unit 14 is not attached to the apparatus main body 2 and the case where the controller 71 determines that the first wire 61 is broken. The introduction of the aforementioned configuration enables the controller 71 to accurately determine whether the switching mechanism 27 has a malfunction.

When the temperature signal is not inputted, the controller 71 determines that the temperature signal corresponding to a temperature equal to or higher than the abnormal temperature Ta is inputted. The introduction of the aforementioned configuration enables the controller 71 to steadily determine a state of attachment of the fixing unit 14 to the apparatus main body 2, even when the temperature signal is not inputted.

When the switching signal is not inputted, the controller 71 determines that the switching signal that remains constant as HIGH is inputted. The introduction of the aforementioned configuration enables the controller 71 to steadily determine a state of attachment of the fixing unit 14 to the apparatus main body 2, even when the switching signal is not inputted.

Moreover, the unit main body 21 includes the upper side guiding part 34 to guide the first wire 61 and the second wire 62 along the front-and-rear direction. The introduction of the aforementioned configuration prevents the first wire 61 and the second wire 62 from being snagged by the member on the side of the apparatus main body 2.

The unit main body 21 further includes the lower side guiding part 35 to guide the cable 63 along the front-and-rear direction. The introduction of the aforementioned configuration prevents the cable 63 from being snagged by the member on the side of the apparatus main body 2.

In the present embodiment, the heating roller 22 having no flexibility is used as the first rotator. However, in another embodiments, a heating belt having flexibility may be used as the first rotator.

In the present embodiment, the image forming apparatus 1 is the multifunctional peripheral. On the other hand, in other embodiments, the image forming apparatus 1 may be a printer, a copying machine, or a facsimile, or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a fixing unit to fix a toner image on a recording medium; and an apparatus main body to which the fixing unit is detachably attached, wherein the fixing unit includes:

a first rotator to be provided rotatably;

a second rotator to be provided rotatably and form a fixing nip in cooperation with the first rotator;

a temperature sensor to output a temperature signal corresponding to a temperature of the first rotator;

a switching mechanism to switch pressure of the fixing nip;

a switching sensor to output a switching signal corresponding to a position of the switching mechanism; and a unit side connector to be connected to the temperature sensor and the switching sensor, wherein the apparatus main body includes:

a main body side connector to be connected to the unit side connector as the fixing unit is attached to the apparatus main body; and a controller to be connected to the main body side connector and determine a state of attachment of the fixing unit to the apparatus main body on a basis of the temperature signal and the switching signal.

2. The image forming apparatus according to claim 1, wherein when the temperature signal and the switching signal are not inputted, the controller determines that the fixing unit is not attached to the apparatus main body, and wherein when at least one of the temperature signal or the switching signal is inputted, the controller determines that the fixing unit is attached to the apparatus main body.

3. The image forming apparatus according to claim 2, wherein the unit side connector is connected to the temperature sensor via a first wire, the switching mechanism shifts between a first position where the switching mechanism makes the pressure of the fixing nip first pressure and a second position where the switching mechanism makes the pressure of the fixing nip second pressure lower than the first pressure, the switching sensor outputs a first signal as the switching signal in a state where the switching mechanism is at the first position and outputs a second signal as the switching signal in a state where the switching mechanism is at the second position, when the temperature signal is not inputted, and the switching signal switched between the first signal and the second signal is inputted, the controller determines that the first wire is broken, when the temperature signal is inputted, and the switching signal that remains constant as the first signal or the second signal is inputted, the controller determines that the switching mechanism has a malfunction, and when the temperature signal is inputted, and the switching signal switched between the first signal and the second signal is inputted, the controller determines that the fixing unit normally operates.

4. The image forming apparatus according to claim 3, wherein when the controller determines that the switching mechanism has the malfunction, the controller increases a detection time of the temperature signal and the switching signal, compared with a case where the controller determines that the fixing unit is not attached to the apparatus main body and a case where the controller determines that the first wire is broken.

5. The image forming apparatus according to claim 3, wherein the apparatus main body further includes a storing device to store an abnormal temperature higher than the temperature of the first rotator at a time when the fixing unit normally operates, and when the temperature signal is not inputted, the controller determines that the temperature signal corresponding to a temperature equal to or higher than the abnormal temperature has been inputted.

6. The image forming apparatus according to claim 3, wherein when the switching signal is not inputted, the controller determines that the switching signal that remains constant as the second signal has been inputted.

7. The image forming apparatus according to claim 3, wherein the first rotator rotates around a rotation axis, the unit side connector is connected to the switching sensor via a second wire, the fixing unit further includes a unit main body to store the first rotator and the second rotator, and the unit main body includes a first guiding part to guide the first wire and the second wire along a rotation axis direction of the first rotator.

8. The image forming apparatus according to claim 7, wherein the fixing unit further includes:

a heat source to heat the first rotator; and a heating stopper to cause the heat source to stop heating the first rotator;

wherein the unit side connector is connected to the heat source and the heating stopper via a cable, and the unit main body further includes a second guiding part to guide the cable along the rotation axis direction.

9. The image forming apparatus according to claim 8, wherein the unit main body includes:

a first protrusion;

a second protrusion arranged on a lower side with respect to the first protrusion; and a third protrusion arranged on a lower side with respect to the second protrusion, wherein the first guiding part is provided between the first protrusion and the second protrusion, and the second guiding part is provided between the second protrusion and the third protrusion.

10. The image forming apparatus according to claim 9, wherein the first protrusion, the second protrusion, and the third protrusion are provided on an outer face of the unit main body, and the fixing unit further includes a cover to cover the outer face of the unit main body.

* * * * *